US005862751A

United States Patent [19]

Triantopoulos et al.

[11] Patent Number: 5,862,751

[45] Date of Patent: Jan. 26, 1999

[54] APPARATUS, METHODS, AND SYSTEMS FOR WIRE MARKING

[75] Inventors: George C. Triantopoulos, Collierville, Tenn.; Edward A. Fischer, Newton, N.J.; Thomas H. Christensen, New Glarus, Wis.

[73] Assignee: Thomas & Betts Corporation, Memphis, Tenn.

[21] Appl. No.: 795,846

[22] Filed: Feb. 6, 1997

Related U.S. Application Data

[63] Continuation of Ser. No. 522,879, Sep. 1, 1995, abandoned.

[51] Int. Cl.[6] ..... B41F 17/00

[52] U.S. Cl. ..... 101/35; 101/4

[58] Field of Search ..... 101/35, 4, 5, 6, 101/41, 44

[56] References Cited

U.S. PATENT DOCUMENTS

| | | | |
|---|---|---|---|
| 3,894,731 | 7/1975 | Evans | 101/4 |
| 3,985,852 | 10/1976 | Evans | 264/132 |
| 4,032,010 | 6/1977 | Evans | 206/345 |
| 4,206,909 | 6/1980 | Wintle | 101/35 |
| 4,440,248 | 4/1984 | Teraoka | 177/4 |
| 4,574,440 | 3/1986 | Wirth et al. | 29/33 |
| 4,582,984 | 4/1986 | Peterpaul et al. | 235/58 |
| 4,586,610 | 5/1986 | Gandolfo | 206/485 |
| 4,636,271 | 1/1987 | Gandolfo | 156/73.1 |
| 4,655,129 | 4/1987 | Wirth et al. | 101/35 |
| 4,734,713 | 3/1988 | Sato et al. | 346/76 PH |
| 4,746,932 | 5/1988 | Sato | 346/76 PH |
| 4,764,086 | 8/1988 | Peterpaul | 400/531 |
| 4,844,629 | 7/1989 | Hoyt | 400/583.3 |
| 4,865,895 | 9/1989 | Vlamings et al. | 428/98 |
| 4,920,882 | 5/1990 | Hoyt | 400/708 |
| 5,078,829 | 1/1992 | Morosini | 156/584 |
| 5,227,617 | 7/1993 | Christopher et al. | 235/462 |
| 5,331,580 | 7/1994 | Miller et al. | 400/88 |
| 5,372,443 | 12/1994 | Borucki, Jr. et al. | 400/649 |
| 5,444,466 | 8/1995 | Smyczek et al. | 347/4 |

*Primary Examiner*—Edgar S. Burr
*Assistant Examiner*—Anthony H. Nguyen
*Attorney, Agent, or Firm*—Hoffmann & Baron, LLP

[57] ABSTRACT

Apparatus for use in providing printed wire markers, comprises a spool of unprinted wire markers, a casing for the spool, the casing bearing sensible indicia defining information related to the encased wire markers, a sensor for sensing the indicia and providing output signals indicative of the information and a wire marker printer for receiving the spooled, unprinted wire markers from the casing and printing thereon accordingly with the information. An elongate wire marker holder device for supporting a wire marker for imprinting thereon, comprises an elongate one-piece body defining an elongate opening and first and second elongate body portions cantilever-supported by the body in the opening and having respective free ends spacedly juxtaposed at a location distal from locations of contiguity of the elongate body portions with the body to define a slot therebetween.

18 Claims, 7 Drawing Sheets

APPARATUS, METHODS, AND SYSTEMS FOR WIRE MARKING

This application is a continuation of application number 08/522,879 filed on Sept. 1, 1995, now abandoned.

FIELD OF THE INVENTION

This invention relates generally to identification devices and pertains more particularly to apparatus, methods and systems for providing printed wire markers for application to electrical conductors.

BACKGROUND OF THE INVENTION

One known practice in fabricating wire markers is to form a wire marker sleeve from a continuous length of extruded plastic tubing and to cut the sleeve into markers of desired length. The markers are supplied to the end user either with preprinting of desired information or in blank for printing by the user. In the latter case, the individual markers are provided in assembly with a marker holding device which supports the markers for imprinting.

One type of assembly of markers and a holding device is shown in commonly-assigned U.S. Pat. No. 4,586,610. The markers are extruded elongate cylinders and the holding device comprises a flat planar member having a plurality of openings through the planar surfaces, the openings being arranged in pairs at opposite sides of the planar member, which defines tabs which extend into ends of markers and releasably retain the markers with the planar member. The assembly may be inserted into a typewriter or other printer for imprinting of the desired wire information on the markers.

Another assembly of markers and holding device is seen in U.S. Pat. No. 4,865,895. Here, the holding device comprises a first carrier strip pair having adhesive on interior faces of the strips and markers are releasably secured to the first carrier strip pair and extend outwardly thereof. A second carrier strip pair is provided at the remote ends of the markers, again having adhesive on interior faces of the strips and accordingly releasably secured to the second carrier strip.

Typically, marker assemblies are encased and, at the user site, are removed from their case, loaded onto a marker spool in a printer and fed into the printer feeding mechanism. From applicants' perspective, this past practice is cumbersome and time consuming. Further, they see presently known holding devices as not assuring high quality imprinting on markers thereby held.

SUMMARY OF THE INVENTION

The primary object of the invention is to overcome the foregoing shortcomings seen in the prior art marker assembly handling and marker holding devices.

More particular objects of the invention are the provision of an improved marker assembly handling operation and system and the provision of improved marker holding devices.

In attaining the former particular object, the invention provides a method for wire marker assembly handling wherein a spool of unprinted wire markers supported by a holding device is encased and wherein sensible indicia are applied to the exterior of the case for sensing at the user location. Upon sensing of the case-applied sensible indicia at the user location by sensing means and leading of the spool of unprinted wire markers from the case into a printing device, the printing device imprints the wire markers with reliance on information contained in the sensible indicia, thereby providing individual wire markers suitable for direct application to wires corresponding thereto.

Apparatus in accordance with the invention includes spooled, unprinted wire markers which may be supported by marker holders of the foregoing type, or other holder, a casing for the spooled, unprinted wire markers, the casing bearing sensible indicia defining information related to the encased wire markers, a sensor for sensing the indicia and providing output signals indicative of the information and a wire marker printer for receiving the spooled, unprinted wire markers from the casing and printing thereon accordingly with the information.

The information is in the nature of "format" data corresponding to the encased wire markers, and the printer is accordingly guided to imprint user-originated data properly on the wire markers.

The foregoing and other objects and features of the invention will be further understood from the following detailed discussion of preferred practices and embodiments thereof and from the drawings wherein like reference numerals identify like components and part throughout.

BRIEF DESCRIPTION OF THE DRAWING FIGURES

DETAILED DESCRIPTION OF THE PREFERRED EMBODIMENTS

Figure 3:
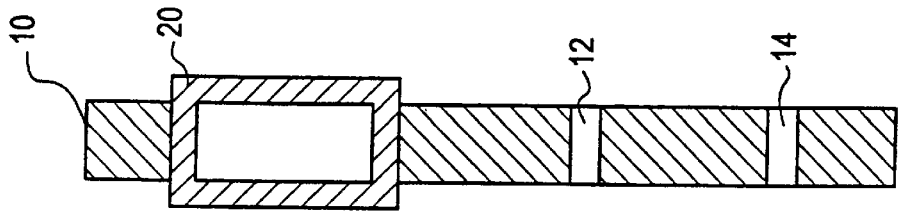
FIG. 3 is a sectional view of the wire marker assembly of FIG. 1 as would be seen from plane III—III of FIG. 1.
Figure 1:
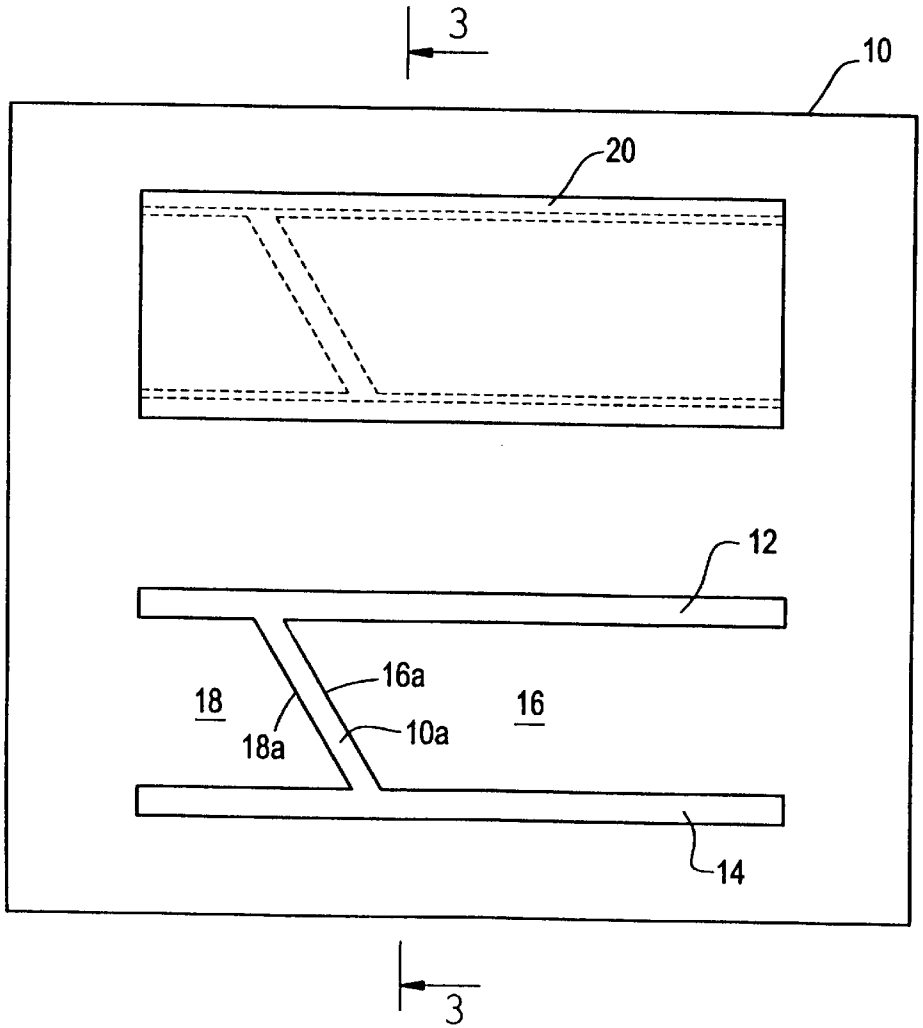
FIG. 1 is a plan elevation of a wire marker assembly in accordance with the invention.
Figure 2:
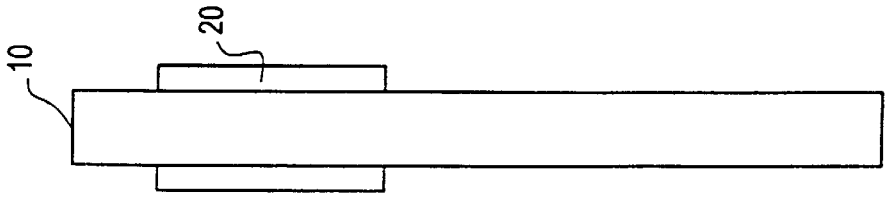
FIG. 2 is a left side elevation of the wire marker assembly of FIG. 1.

Referring to the lower portions of FIGS. 1–3, a wire marker holder of the invention comprises a one-piece body 10 defining respective transversely spaced, elongate openings 12 and 14 therethrough and first and second elongate body portions 16 and 18, cantilever-supported by body 10 at respective locations of contiguity of the elongate body portions with the body.

Body 10 further defines slot 10*a*, longitudinally disposed between the first and second elongate body portions, particularly between juxtaposed ends 16*a* and 18*a* thereof. Slot 10*a* extends transversely of body 10 and is disposed at an acute angle with respect to the longitudinal axis of body 10.

First and second elongate body portions 16 and 18 are of respective different dimensions longitudinally of body 10, with the former being a length which is a multiple of the length of the latter. Further, the first and second elongate portions will be seen to define respective end parts in mutually overlapping relation longitudinally of body 10.

Whereas the referenced lower portions of FIGS. 1–3 depict the wire marker holder without a wire marker thereby supported, the upper portions of FIGS. 1–3 depict a wire marker 20 in assembly with the wire marker holder.

In reaching the assembly of the upper portions of FIGS. 1–3, wire marker 20 is disposed leftwardly of body 10 and thereabove, in longitudinal alignment with elongate body portions 16 and 18, and the former is displaced outwardly of body 10. Wire marker 20 is generally tubular and open at both ends thereof. Elongate body portion 16 is now inserted into the leftward open end of wire marker 20 and fully into wire marker 20, this step being facilitated by the tapered character of the free end of the elongate body portion. Then, elongate body portion 18 is displaced outwardly of body 10 and into the other end of wire marker 20 and fully into wire marker 20. At that juncture, the various parts are released and wire marker 20 assumes its showing in the upper portions of FIGS. 1–3, i.e., in nesting relation with elongate body portions 16 and 18 and generally flat against them.

Figure 4:
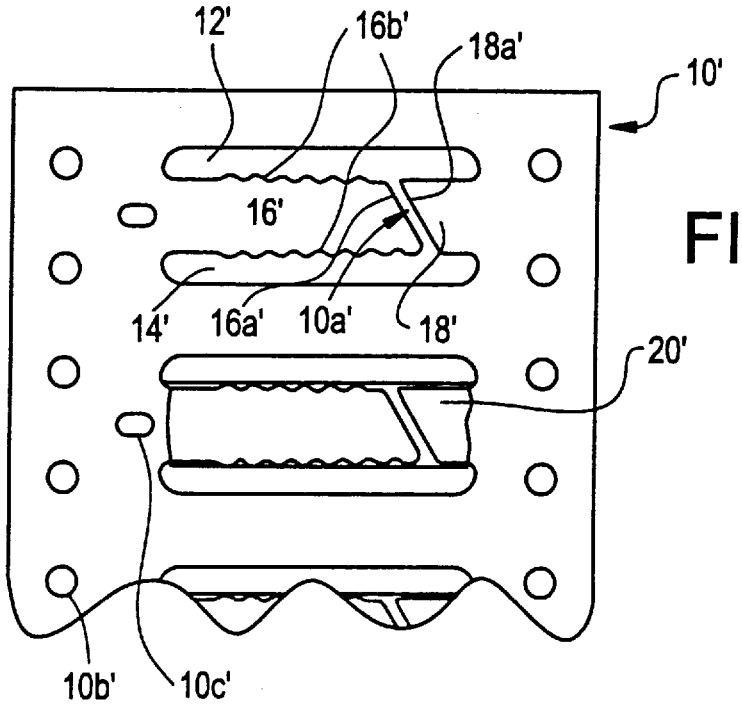
FIG. 4 is a plan elevation of a further wire marker assembly in accordance with the invention.

Turning to the upper portion of FIG. 4, a further wire marker holder of the invention comprises a one-piece body 10' defining respective transversely spaced, elongate openings 12' and 14' therethrough and first and second elongate body portions 16' and 18', cantilever-supported by body 10' at respective locations of contiguity of the elongate body portions with the body.

Body 10' further defines slot 10*a*', longitudinally disposed between the first and second elongate body portions, particularly between juxtaposed ends 16*a*' and 18*a*' thereof. Slot 10*a*' extends transversely of body 10' and is disposed at an acute angle with respect to the longitudinal axis of body 10'.

First and second elongate body portions 16' and 18' are of respective different dimensions longitudinally of body 10', with the former being a length which is a multiple of the length of the latter. Further, the first and second elongate portions will be seen to define respective end parts in mutually overlapping relation longitudinally of body 10'. Body 10' is shown with conventional sprocket holes 10*b*' and indexing slots 10*c*', although markings, such as ink dots may also be used.

Whereas the referenced upper portion of FIG. 4 depicts the wire marker holder without a wire marker thereby supported, the lower portions of FIG. 4 depict a wire marker 20' in assembly with the wire marker holder.

Referring again to the upper portion of FIG. 4, elongate body portion 16' will be seen to include opposed serrated or wavy margins, i.e., each margin having undulations 16*b*' with crests and adjacent valleys. The crests are so dimensioned as to be in interference fit with the interior of applied wire marker 20' and are found to enhance retention of the marker with the elongate body member.

Figure 5:
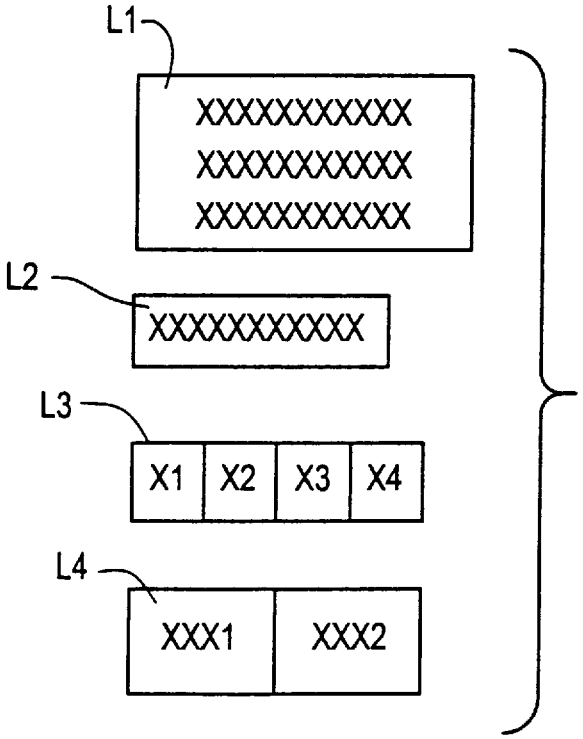
FIG. 5 is shows various types of wire marker labels.

FIG. 5 depicts various types of labels, L1 being a three row, nine elements per row, single label, L2 being a single row, nine element, single label, L3 being a collection of four single row, two element labels, mutually separable for use, and L4 being a collection of two single row, four element labels, mutually separable for use.

Figure 6:
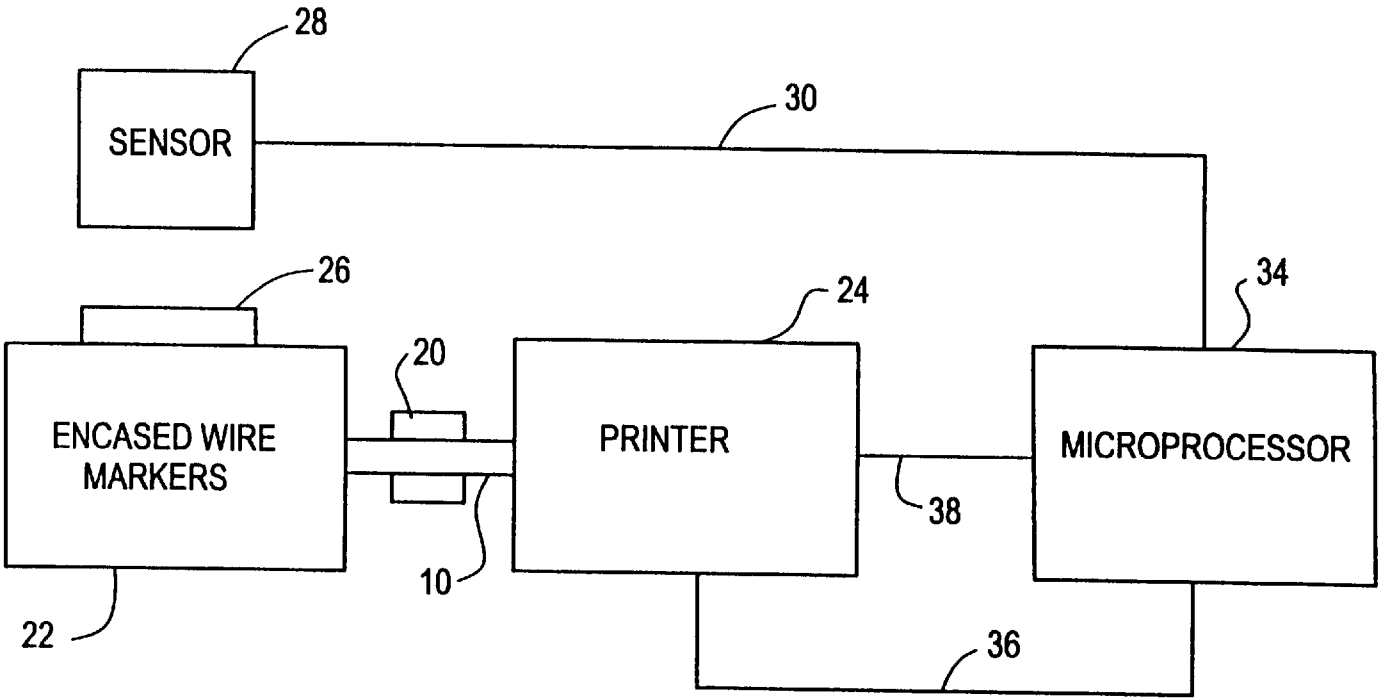
FIG. 6 is a generalized showing of apparatus and system in accordance with the invention.
Figure 7:
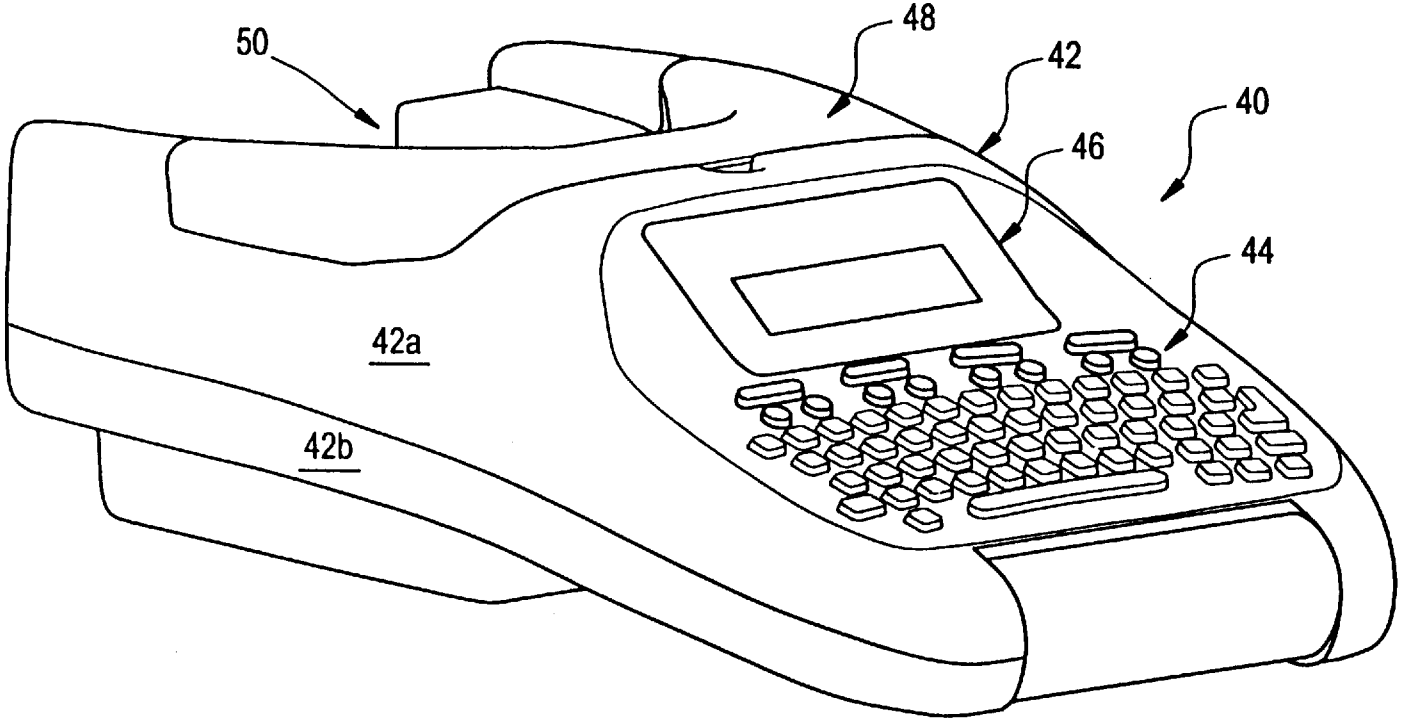
FIG. 7 is a perspective view showing the front, left side and top of a preferred embodiment of apparatus in accordance with the invention.
Figure 8:
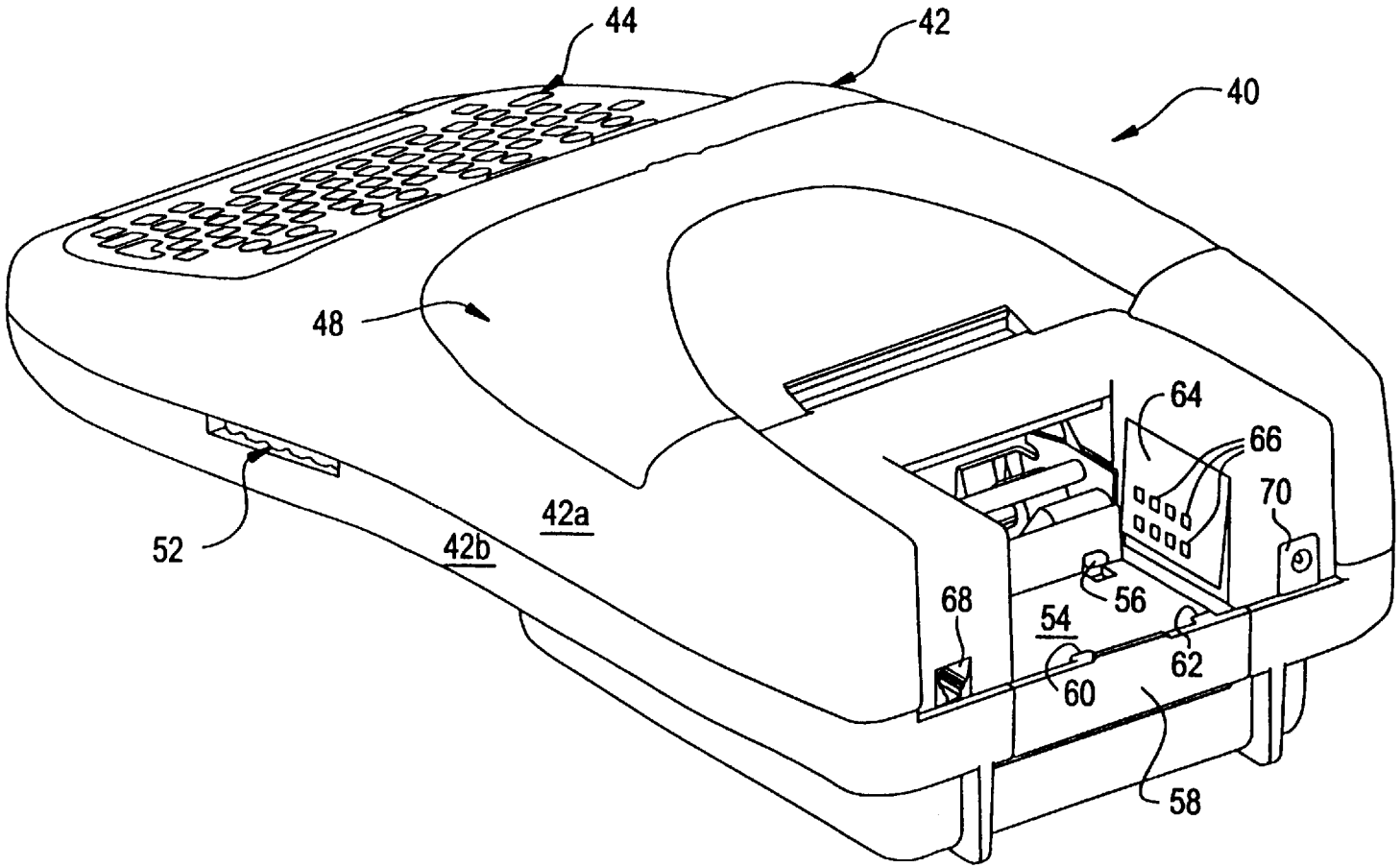
FIG. 8 is a perspective view showing the rear, right side and top of the FIG. 7 apparatus.
Figure 9:
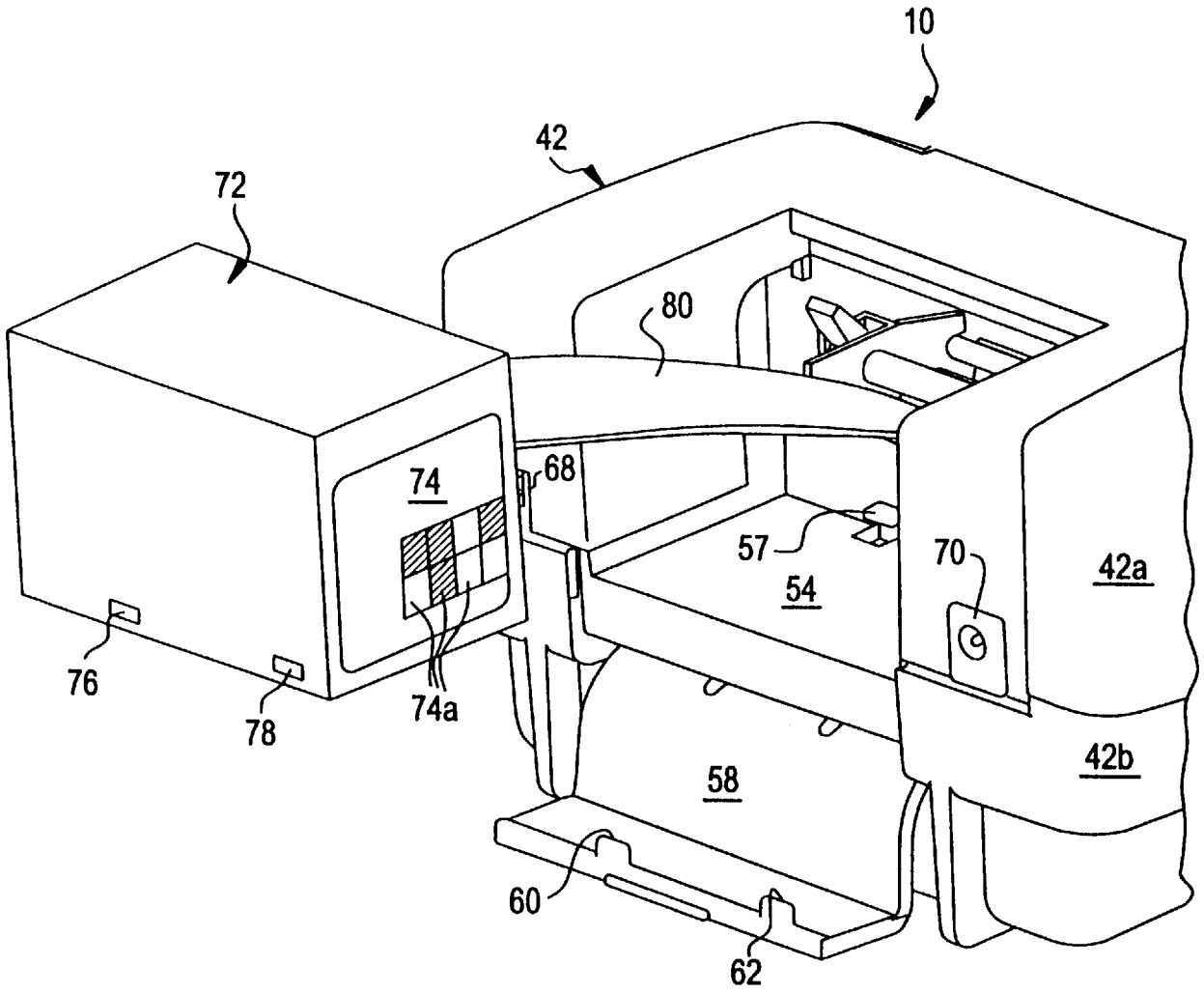
FIG. 9 is a perspective view showing the rear, left side and top of the FIG. 7 apparatus including a wire marker carton in disposition to be placed in a rear compartment of the apparatus.
Figure 10:
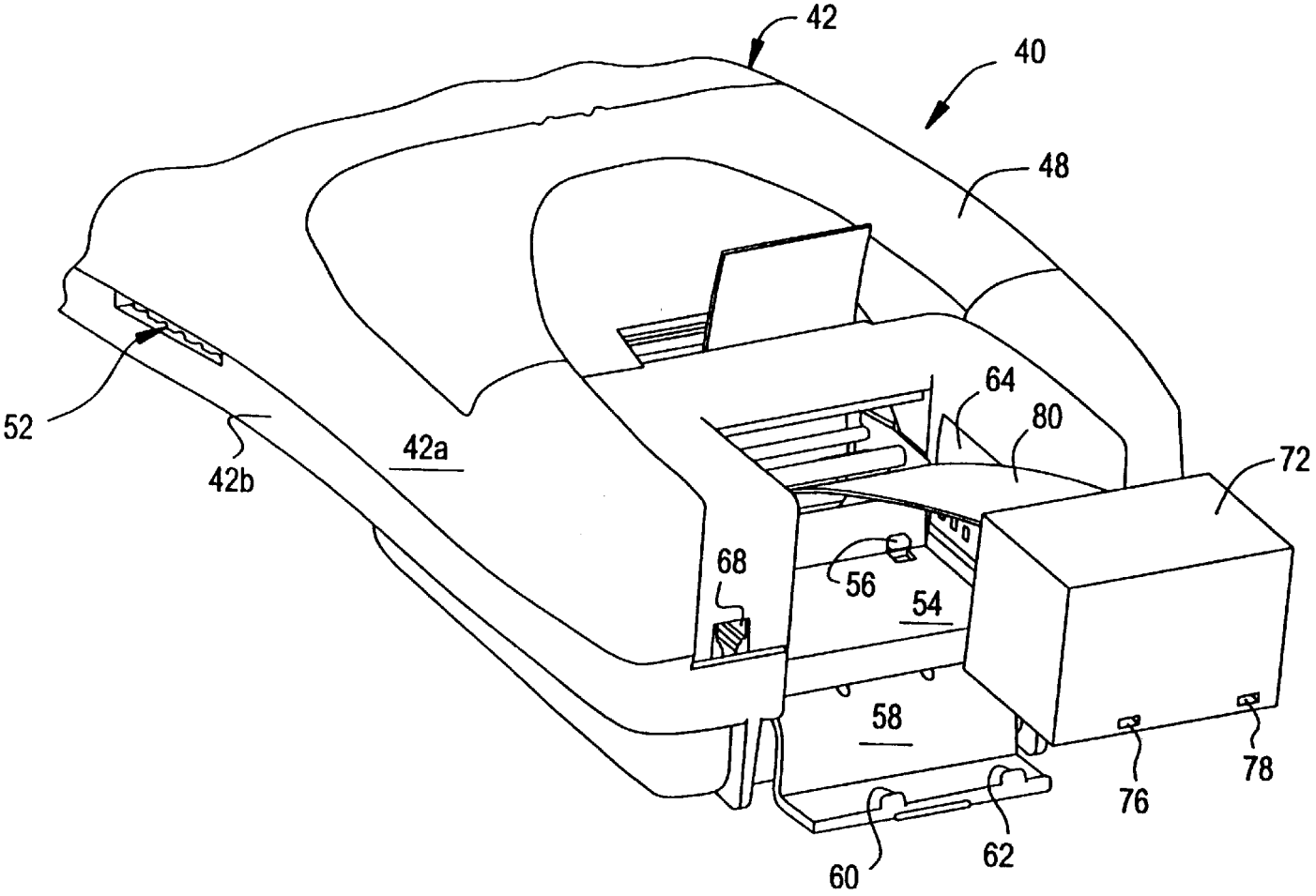
FIG. 10 is a perspective view showing the rear, right side and top of the FIG. 7 apparatus with the wire marker carton in such disposition to be placed in a rear compartment of the apparatus.

Turning to FIG. 6, apparatus of the invention comprises casing 22, having spooled, unmarked wire markers therein and defining an exit opening (not shown) through which the spool may be drawn. One body 10 and its associated wire marker 20 are seen as. having issued through the exit opening and advancing toward printer 24.

Casing 22 includes on an exterior surface thereof sensible indicia 26. Sensor 28 is moved into registry with casing 22, or vice versa, to enable sensing of the indicia and sensor 28 provides output signals on lines 30 indicative of the information contained in the sensed indicia.

The information contained in the sensed indicia are generally of "format" nature for printer 24, i.e., to enable the printer, through control and information signals provided thereto by microprocessor 34 over lines 36, to provide properly imprinted wire markers. In this connection, microprocessor 34 receives the sensed format information from sensor 28 over lines 30. The information may be include such as pitch of spooled wire markers (longitudinal spacing between adjacent wire markers), length and width of spooled wire markers, number of wire markers spooled transversely, etc. i.e., information of the types of labels shown in FIG. 5 and discussed above.

Microprocessor 34 receives or stores further information which is user-originated, such as what is to be the printing text, what is to be the printing font, etc. Thus, since a given wire marker length will permit different maximum numbers of characters for different printing fonts, the microprocessor associates sensed wire marker length with user-originate font selection and user-originated measure of printing text to properly advise the printer of printing instructions. Likewise, as another example, where the sensed indicia indicates that there are plural wire markers to be presented to the printer at the same time, i.e., plural transversely spaced wire markers are spooled as shown also in FIG. 5, the microprocessor is informed on the basis of sensed information in respect of transverse indexing of the printing head per individual longitudinal spool wire marker feed.

Microprocessor 34 provides signals also over lines 38 to printer 24 for advancing wire markers from their casing. As will be appreciated, the term "spool", while connoting spirally wound, is intended to encompass any succession of wire marker assemblies arranged in such succession as to be advanced to a printer, e.g., a web bearing wire markers adhesively secured thereto and arranged as a vertically-stacked, marginally-connected series of web sheets.

As is shown in FIGS. 7–10, apparatus 40 of the invention includes housing 42, comprised of upper and lower segments 42*a* and 42*b*, which are separable for effecting adjustments, trouble shooting, repair, etc. Housing 42 supports keyboard 44 and LCD (liquid crystal display) 46 and includes a printing mechanism therewithin, cover 48 being openable for replacing a printing cartridge for the printing mechanism. Rearward open compartment 50 affords seating of a wire marker carton in housing 42. Slot 52 is for the releasable receipt of a memory card (commonly known as PCMCIA) in apparatus 40.

Compartment 50 includes floor 54 and forward detents 56 and 57. Lid 58 is pivotally supported by housing segment 42*b* and includes detents 60 and 62. An interior bounding sidewall of compartment 54 supports sensor assembly 64, which includes transducer assemblies 66, shown as eight in number and each including a light-emitting diode (LED) or like source of radiant energy and a photocell or like electrooptic transducer.

Wire marker carton 72 has sensible indicia panel 74, with indicia 74*a*. In the illustrated indicia example, eight indicia are present in configuration to register with the eight transducer assemblies 66, the indicia being either radiant energy-reflective (unshaded) or non-radiant energy-reflective (shaded). Apertures 76 and 78 are disposed for registry with detents 60 and 62 when lid 58 is closed, following seating of carton 72 on compartment floor 54, and detents 56 and 57 likewise register with apertures (not shown) in the forward panel of the carton. Wire marker web 80 is illustrated as having been drawn from carton 72 and threaded into the printing mechanism of apparatus 40.

Given that there are eight indicia possibilities in panel 74, and that the indicia are binary in nature, reflective or non-reflective, it will be appreciated that the panel may be configured in its indicia to identify any specific one of two hundred and fifty-six diverse carton wire marker contents. It should be appreciated that more or less than eight indicia possibilities may be provided.

By way of summary of the foregoing and introduction to the ensuing claims, the invention will be seen as a method comprising the steps of providing a spool of unprinted wire markers, encasing the spool of unprinted wire markers in a case, applying sensible indicia to the case indicative of information relating to characteristics of the unprinted wire markers, sensing the sensible indicia and providing signals indicative of the information relating to characteristics of the unprinted wire markers and printing text on the wire markers by using the output signals. Such method includes the further step of effecting the printing step by also using printing text information provided independently of practice of the sensing step. The information relating to characteristics of the unprinted wire markers is selected to be format information for printing apparatus used in the step of printing text. The format information is selected from group consisting of length of wire markers, spacing longitudinally between spooled wire markers and numbers of wire markers transversely of the spooling.

The invention also provides apparatus for use in providing printed wire markers, comprising a spool of unprinted wire markers, a casing for the spool, the casing bearing sensible indicia defining information related to the encased wire markers, a sensor for sensing the indicia and providing output signals indicative of the information and a wire marker printer for receiving the spooled, unprinted wire markers from the casing and printing thereon accordingly with the information.

The apparatus for use in making printed wire markers shown in FIGS. 7–10 will be seen to comprise printing means disposed in the apparatus for printing wire markers, a carton-receiving compartment in the apparatus and sensing means disposed adjacent the compartment in the apparatus for generating electrical output signals indicative of sensible indicia on a carton disposed in the compartment.

The sensing means comprises a plurality of transducers having respective fields of view extending into the compartment. The apparatus further comprises a closure lid for the compartment supported for movement into engagement with a carton disposed in the compartment. The lid includes at least one detent for retentive engagement with a carton disposed in the compartment upon movement of the lid into engagement with a carton disposed in the compartment. The apparatus defines at least one detent fixedly disposed therein for retentive engagement with a carton disposed in the compartment. The apparatus may further include a keyboard accessible exteriorly of the apparatus and means for receiving a magnetic disk, means for connecting the apparatus with an external modem.

A combination in accordance with invention includes apparatus for use in making printed wire markers, comprising printing means disposed in the apparatus for printing wire markers, a carton-receiving compartment in the apparatus and sensing means disposed adjacent the compartment in the apparatus for generating electrical output signals indicative of indicia sensed by the sensing means and a carton disposed in the compartment, the carton having sensible indicia thereon located in registry with the sensing means.

Various changes to the particularly disclosed embodiment and practices may evidently be introduced without departing from the invention. Accordingly, it is to be appreciated that the particularly discussed and depicted preferred embodiments and practices of the invention are intended in an illustrative and not in a limiting sense. The true spirit and scope of the invention are set forth in the ensuing claims.

What is claimed is:

1. Apparatus for use in making printed wire markers, comprising:

(a) printing means disposed in said apparatus for printing wire markers;

(b) a carton-receiving compartment in said apparatus; and (c) sensing means disposed adjacent said compartment in said apparatus for generating electrical output signals indicative of sensible indicia on a carton disposed in said compartment.

2. The apparatus claimed in claim 1, wherein said sensing means comprises a plurality of transducers having respective fields of view extending into said compartment.

3. The apparatus claimed in claim 1, further comprising a closure lid for said compartment supported for movement into engagement with a carton disposed in said compartment.

4. The apparatus claimed in claim 3, wherein said lid includes at least one detent for retentive engagement with a carton disposed in said compartment upon movement of said lid into engagement with a carton disposed in said compartment.

5. The apparatus claimed in claim 4, wherein said apparatus defines at least one detent fixedly disposed therein for retentive engagement with a carton disposed in said compartment.

6. The apparatus claimed in claim 1, further including a keyboard accessible exteriorly of said apparatus.

7. The apparatus claimed in claim 1, further including means for receiving a memory card.

8. The apparatus claimed in claim 1, further including connection means for connecting said apparatus with an external source.

9. In combination:

(a) apparatus for use in making printed wire markers, comprising:

(1) printing means disposed in said apparatus for printing wire markers, (2) a carton-receiving compartment in said apparatus, and (3) sensing means disposed adjacent said compartment in said apparatus for generating electrical output signals indicative of indicia sensed by said sensing means; and (b) a carton disposed in said compartment, said carton having sensible indicia thereon located in registry with said sensing means.

10. The invention claimed in claim 9, wherein said sensing means comprises a plurality of transducers having respective fields of view extending into said compartment.

11. The invention claimed in claim 9, further comprising a closure lid for said compartment supported for movement into engagement with a carton disposed in said compartment.

12. The invention claimed in claim 11, wherein said lid includes at least one detent for retentive engagement with a carton disposed in said compartment upon movement of said lid into engagement with a carton disposed in said compartment.

13. The invention claimed in claim 12, wherein said apparatus defines at least one detent fixedly disposed therein for retentive engagement with a carton disposed in said compartment.

14. The invention claimed in claim 12, wherein said apparatus includes a keyboard accessible exteriorly of said apparatus.

15. The invention claimed in claim 9, wherein said apparatus includes means for receiving a memory card.

16. The invention claimed in claim 9, wherein said apparatus includes connection means for connecting said apparatus with an external source.

17. The invention claimed in claim 9, wherein said carton sensible indicia comprise an array of respective energy-reflective and energy-non-reflective surfaces accessible exteriorly of said carton.

18. The invention claimed in claim 17, wherein said sensing means comprises a plurality of transducers having respective fields of view extending into said compartment and means for issuing radiant energy into said compartment.

* * * * *